US010604951B2

(12) United States Patent
Jablonski

(10) Patent No.: US 10,604,951 B2
(45) Date of Patent: Mar. 31, 2020

(54) SUPPORT MEMBER FOR JOINABLE SCAFFOLDING PLANKS

(71) Applicant: Alum-A-Pole Corporation, Scranton, PA (US)

(72) Inventor: Kevin Jablonski, Scranton, PA (US)

(73) Assignee: ALUM-A-POLE CORPORATION, Scranton, PA (US)

( * ) Notice: Subject to any disclaimer, the term of this patent is extended or adjusted under 35 U.S.C. 154(b) by 149 days.

(21) Appl. No.: 15/803,135

(22) Filed: Nov. 3, 2017

(65) Prior Publication Data

US 2018/0119435 A1 May 3, 2018

Related U.S. Application Data

(60) Provisional application No. 62/417,018, filed on Nov. 3, 2016.

(51) Int. Cl.

| | |
|---|---|
| ***E04G 7/04*** | (2006.01) |
| ***E04G 5/08*** | (2006.01) |
| ***E04G 1/15*** | (2006.01) |
| ***E04G 7/28*** | (2006.01) |
| ***E04G 7/30*** | (2006.01) |

(52) U.S. Cl.

CPC ..... *E04G 7/04* (2013.01); *E04G 1/154* (2013.01); *E04G 5/08* (2013.01); *E04G 7/28* (2013.01); *E04G 7/301* (2013.01); *E04G 7/307* (2013.01)

(58) Field of Classification Search

CPC .... E04G 7/04; E04G 7/28; E04G 5/08; E04G 7/301; E04G 7/307; E04G 1/154

USPC ..... 248/235

See application file for complete search history.

(56) References Cited

U.S. PATENT DOCUMENTS

| | | | | | |
|---|---|---|---|---|---|
| 4,444,321 | A * | 4/1984 | Carlstrom | ..... | A47F 5/005 211/186 |
| 4,463,828 | A * | 8/1984 | Anderson | ..... | A63B 27/00 182/136 |
| 4,499,967 | A * | 2/1985 | Anderson | ..... | E04G 1/154 182/145 |
| 4,597,471 | A * | 7/1986 | Anderson | ..... | A63B 27/04 182/132 |
| 4,598,794 | A * | 7/1986 | Anderson | ..... | E04G 1/20 182/113 |

(Continued)

FOREIGN PATENT DOCUMENTS

| | | | | |
|---|---|---|---|---|
| DE | 2341167 A1 * | 10/1974 | ..... | E04G 1/151 |
| DE | 19612537 A1 * | 10/1996 | ..... | E04G 1/152 |

(Continued)

*Primary Examiner* — Eret C McNichols

(74) *Attorney, Agent, or Firm* — Myers Wolin, LLC

(57) ABSTRACT

A support member is provided for joining scaffolding plank segments comprising a first support surface for supporting a first scaffolding plank segment and a second support surface parallel to the first support surface for supporting a second scaffolding plank segment. A joining member joins the first and second plank segments, a first retainer is provided for retaining the first scaffolding plank segment on the first support surface and a second retainer for retaining the second scaffolding plank segment on the second support surface. A system is further provided comprising at least two scaffolding plank segments and a bracket, such as that described above, for supporting an end of each of the segments.

11 Claims, 4 Drawing Sheets

(56) References Cited

U.S. PATENT DOCUMENTS 4,624,342 A * 11/1986 Anderson ..... E04G 1/20 182/223
4,741,505 A * 5/1988 Anderson ..... E04G 1/20 248/357
4,805,735 A * 2/1989 Anderson ..... E04G 1/20 182/129
4,955,584 A * 9/1990 Anderson ..... A63B 27/00 182/133
5,884,725 A * 3/1999 Reyland ..... E04G 1/15 182/113
5,894,909 A * 4/1999 Cornish ..... E04G 1/154 182/119
6,000,495 A * 12/1999 Brinegar ..... E04G 1/154 182/119
6,886,662 B2 * 5/2005 Riley ..... E04G 3/22 182/82
6,912,819 B2 * 7/2005 Price ..... E04B 2/44 405/284
7,661,512 B2 * 2/2010 Feldmiller, Jr. ..... B66F 1/00 182/133
8,181,742 B1 * 5/2012 Ranese ..... E04G 3/28 182/136
2005/0045787 A1 * 3/2005 Magnusson ..... A47B 96/024 248/235
2011/0036665 A1 * 2/2011 Kreller ..... E04G 7/28 182/179.1
2016/0002936 A1 * 1/2016 Cox ..... E04G 1/06 182/130
2017/0191276 A1 * 7/2017 Young ..... E04G 7/34
2018/0119434 A1 * 5/2018 Mikic ..... E04G 1/152
2019/0161981 A1 * 5/2019 Westlake ..... E04G 1/153

FOREIGN PATENT DOCUMENTS

DE 102013108336 A1 * 2/2015 ..... E04G 5/08
EP 0238680 A1 * 9/1987 ..... E04G 1/152
GB 1032683 A * 6/1966 ..... E04G 5/08
GB 2206635 B * 1/1992 ..... E04G 5/08
GB 2533033 A * 6/2016 ..... E04G 5/08
WO WO-2014204283 A1 * 12/2014 ..... E04G 7/28

* cited by examiner

SUPPORT MEMBER FOR JOINABLE SCAFFOLDING PLANKS

CROSS-REFERENCE TO RELATED APPLICATIONS

This application claims the benefit of U.S. Provisional Patent Application No. 62/417,018, filed Nov. 3, 2016, the contents of which is hereby incorporated by reference in their entirety.

FIELD OF THE INVENTION

The present invention is directed to scaffolding equipment.

BACKGROUND

Builders and other workmen use scaffolding as a support structure to support workers, tools, and supplies adjacent a building structure in need of work or being constructed. Scaffolding is often portable, can be easily constructed at a job site, and is adjustable to the needs of a given job.

Scaffolding typically comprises support poles, and planks, which are sometimes known as staging, or work platforms, for workers to walk on. Scaffolding typically further comprises brackets for retaining the planks at a specified height on the poles.

Pump jack scaffolding typically includes a bracket incorporating a jack mechanism for adjusting the height of the planks. The brackets are then fixed to the support poles and may be raised and lowered on the support poles by pumping or releasing the jack mechanism.

In some scaffolding assemblies, a single bracket may be used to retain multiple planks, such that the ends of two planks may meet at the bracket. Each plank may then rest on a portion of the bracket. In such embodiments, a mechanism may be incorporated to join the ends of the two planks. However, this joining mechanism may itself be unstable, and may merely be a flexible chain, resulting in planks that still move relative to each other. Further the two planks may move together if too much slack is provided in the joining mechanism, such that a plank may slide off of a corresponding bracket. Finally, in some cases, a worker may fail to properly secure the joining mechanism, which may result in a system collapse and worker injuries.

There is a need for a scaffolding bracket on which multiple planks may be easily and safely secured.

SUMMARY

A support member is provided for joining scaffolding plank segments comprising a first support surface for supporting a first scaffolding plank segment and a second support surface parallel to the first support surface for supporting a second scaffolding plank segment. A joining member joins the first and second plank segments, a first retainer is provided for retaining the first scaffolding plank segment on the first support surface and a second retainer for retaining the second scaffolding plank segment on the second support surface.

The joining member may be, for example, a chain for passing through endpieces of the scaffolding plank segments, and the support member may have a fixation point for anchoring the chain.

In some embodiments, the retainers are vertical surfaces that prevent the corresponding scaffolding staging segments from sliding off of the support surfaces. Typically, the retainers are connected by a central connecter and together form a bracket.

The described support member may be a portion of a pump jack scaffolding bracket.

A system is further provided comprising at least two scaffolding plank segments and a bracket, such as that described above, for supporting an end of each of the segments.

DETAILED DESCRIPTION OF THE PREFERRED EMBODIMENTS

Figure 1:
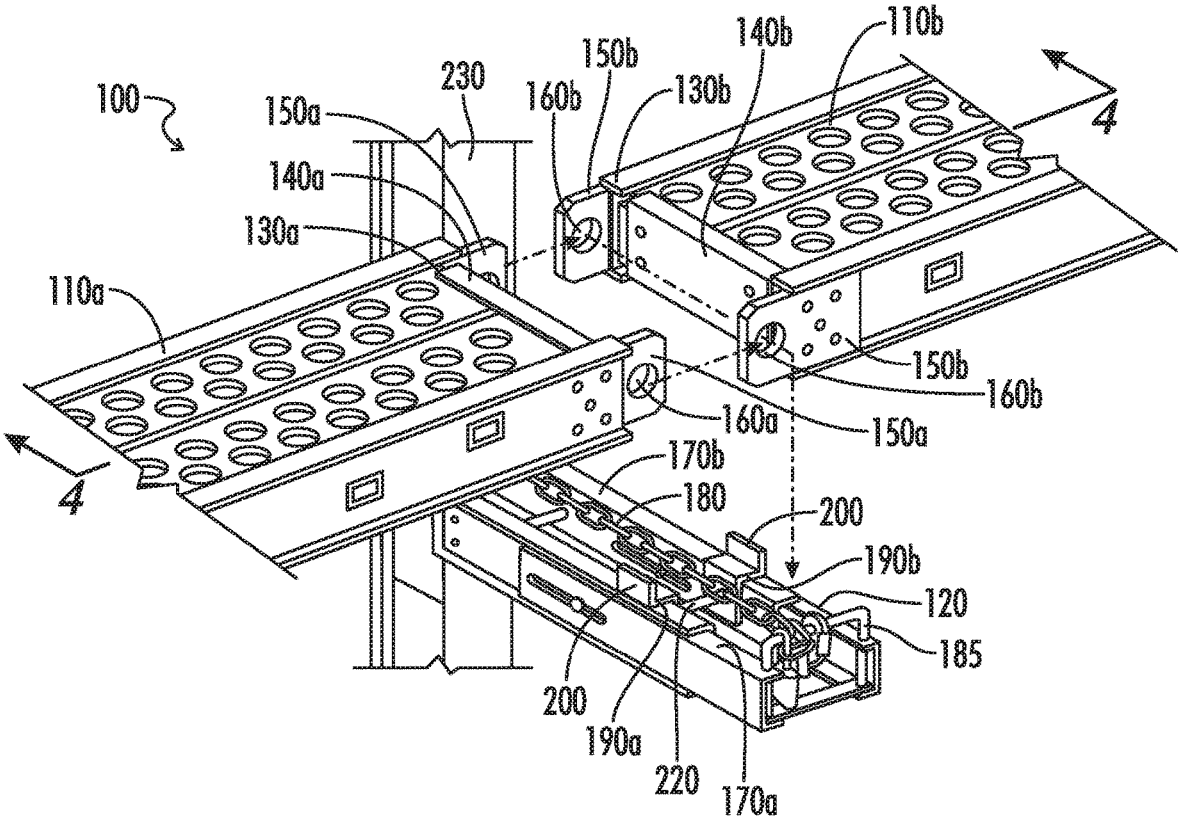
FIG. 1 is a segment of a scaffolding system at which multiple planks meet, shown with the segments separated.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

Figure 2:
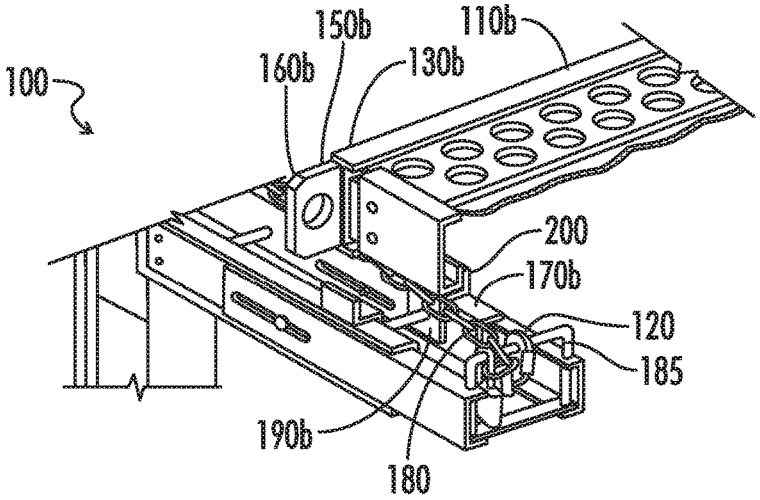
FIG. 2 is a sectioned view of the segment of the scaffolding system of FIG. 1 assembled.
Figure 3:
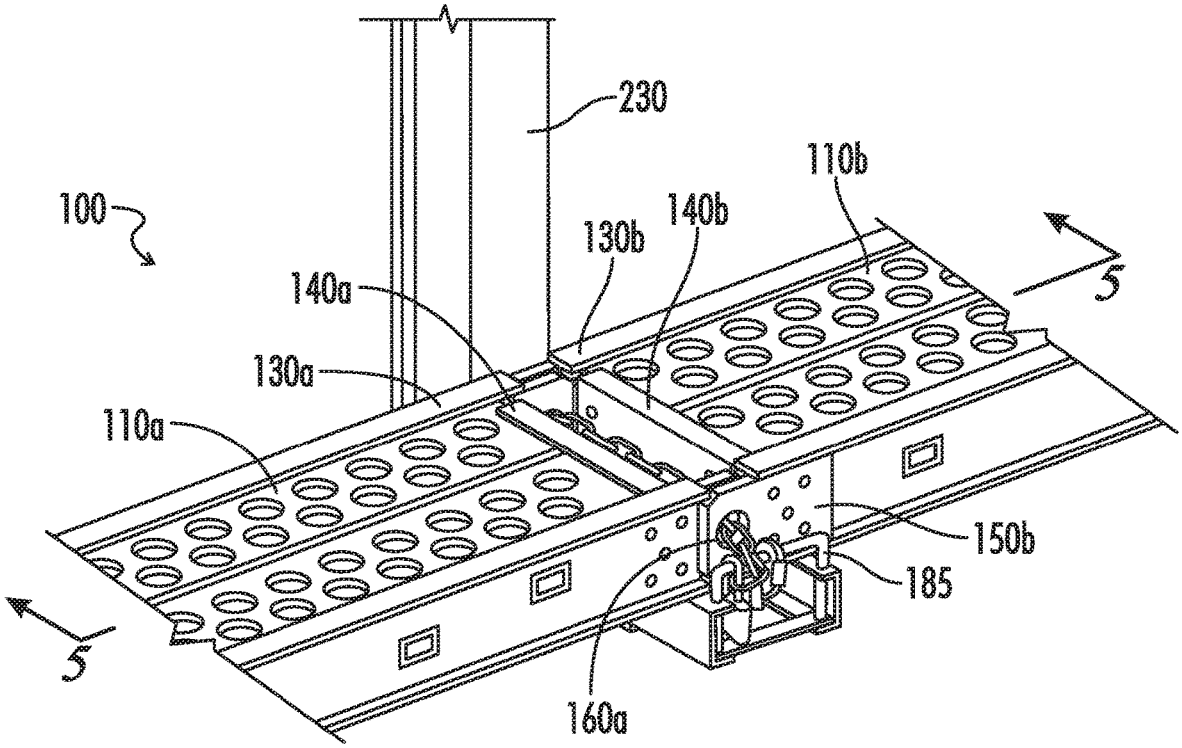
FIG. 3 is the segment of the scaffolding system of FIG. 1 assembled.

FIG. 1 is a segment of a scaffolding system at which multiple planks meet, shown with the segments separated and FIG. 2 is a sectioned view of the same segment assembled. FIG. 3 is the segment of the scaffolding system assembled.

As shown, a scaffolding system 100 has two scaffolding plank segments 110*a*, 110*b*, and a bracket 120 that provides support for an end 130*a*, 130*b* of each of the plank segments. The scaffolding system 100 has additional supports (not shown) supporting each of the plank segments beyond the segmented edges shown in the figures. Typically, the plank segments 110 form a walking or working surface, and are supported by brackets at various points along the length of, or at the ends of, the plank segments.

The plank segments 110*a*, 110*b* each end in an end cap 140*a*, 140*b*, and each further contain endpieces 150*a*, 150*b* mounted on the corners of the planks, each containing holes 160*a*, 160*b* to be utilized for fixing the plank segments to each other.

The bracket 120 has support surfaces 170*a*, 170*b* for supporting the corresponding ends 130*a*, 130*b* of the plank segments 110*a*, 110*b* and a chain 180 installed on the bracket 120 joins the ends of the plank segments when assembled. Accordingly, when the scaffolding system 100 is assembled, the chain 180 passes through the holes 160 of the endpieces 150 and thereby fixes the plank segments 110*a*, 110*b* to each other at the bracket 120 such that the end caps 140 rest on the corresponding support surfaces 170. The bracket 120 may be further provided with a fixation point 185 for anchoring the chain while the scaffolding system is in use such that the plank segments 110*a*, 110*b* cannot separate.

The bracket 120 is further provided with retainers 190*a*, 190*b* on each support surface 170*a*, 170*b* that each interface with the corresponding end cap 140*a*, 140*b* and prevent the plank segments 110 from sliding relative to the support surfaces. As shown, the retainers 190 typically contain vertical surfaces 200 that each abut the corresponding end cap 140 and prevent it from moving towards the plank segment 110 to which it is connected. The retainers 190 may be components of a single retaining bracket, and may therefore be connected by a central connector 220.

The bracket 120 may be part of a pump jack scaffolding system 100, and may therefore contain a jack for mounting on a pole 230. In such an embodiment, the jack may contain a foot pedal, and may be used to move the bracket 120 up and down on the pole 230.

Figure 4:
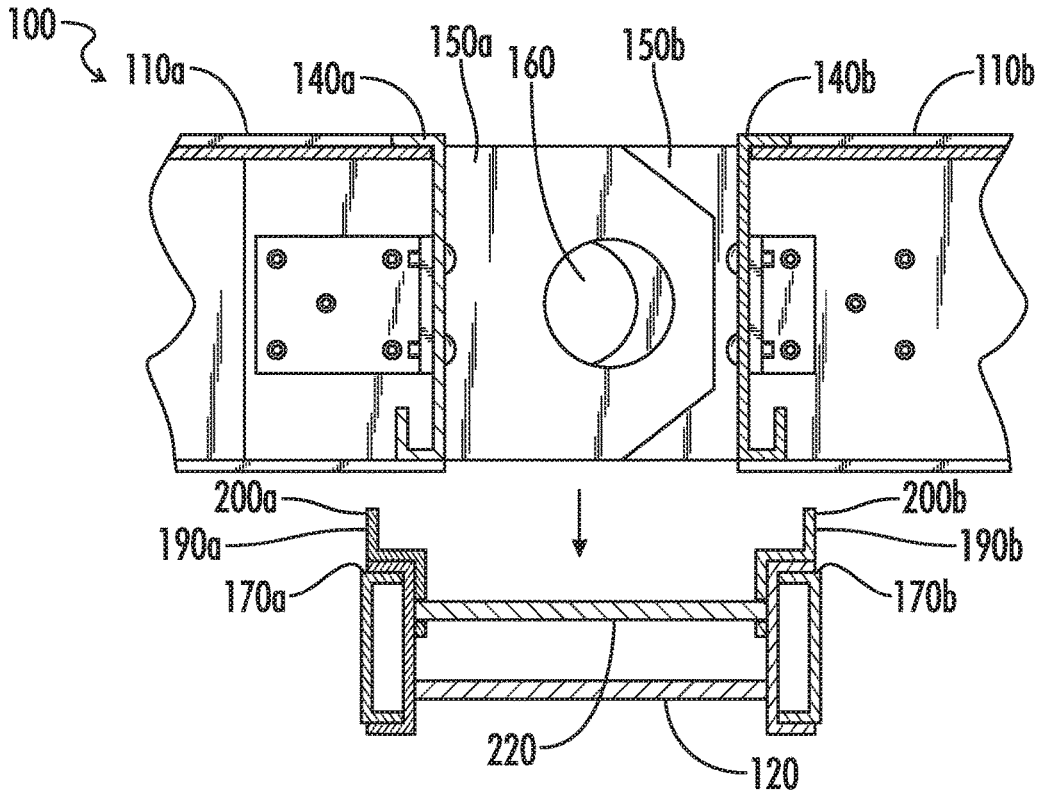
FIG. 4 is a cross section of the scaffolding system of FIG. 1 taken along line 4-4 partially assembled in a first configuration.

FIG. 4 is a cross section of the scaffolding system 100 of FIG. 1 taken along line 4-4 partially assembled. As shown, the plank segments 110*a*, 110*b* are positioned adjacent each other such that the combined holes 160 in their endpieces 150*a*, 150*b* overlap. The plank segments 110 are then positioned over the bracket 120 and lowered into position.

Figure 5:
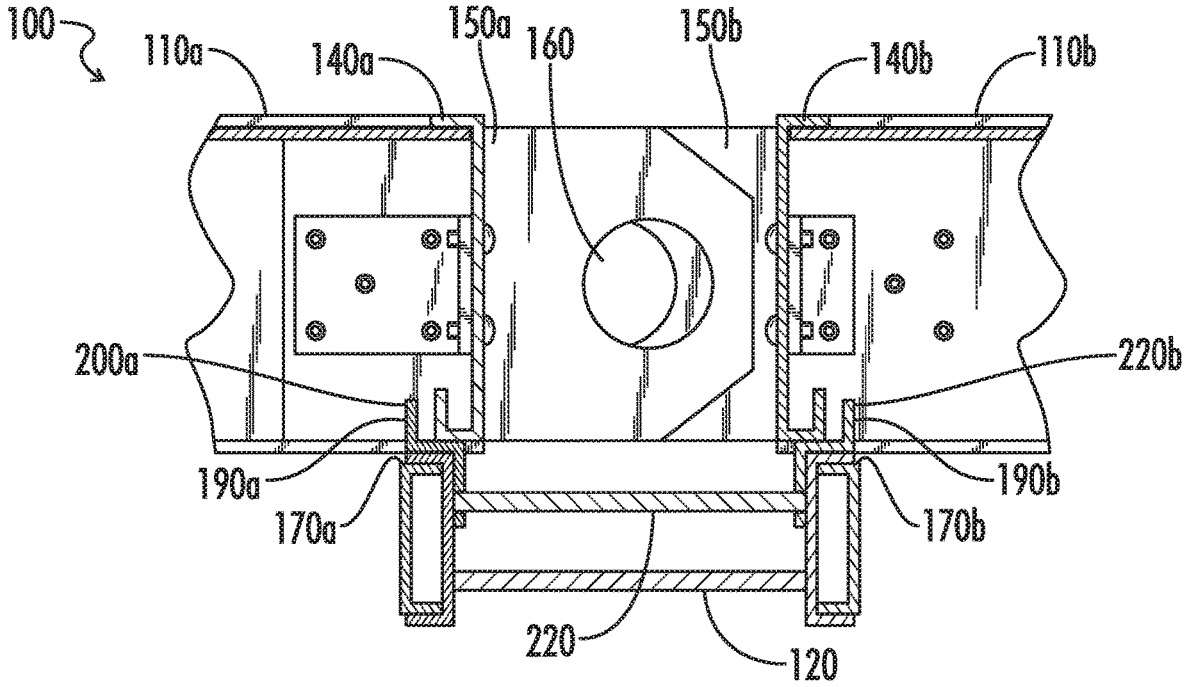
FIG. 5 is a cross section of FIG. 3 taken along line 5-5.

FIG. 5 is a cross section of FIG. 3 taken along line 5-5 and shows the plank segments 110 after they are lowered into position on the bracket 120. As shown, the end cap 140*a* of the first plank segment 110*a* is positioned adjacent the retainer 190*a* on the support surface 170*a*, such that the vertical surface 200*a* faces the end cap. The second plank segment 110*b* is similarly arranged on the second support surface 170*b* opposite the first plank segment 110*b*. Once positioned in this way, the vertical surfaces 200*a*, 200*b* prevent the plank segments 110 from moving away from each other. As shown, the vertical surfaces 200*a*, 200*b* may be spaced apart from the corresponding end caps 140*a*, 140*b*, such that they are provided with a small amount of play. In this way, the connection may avoid an overly rigid construction and associated risks and failures. Alternatively, one or both of the vertical surfaces 200*a*, 200*b* may abut the end caps 140*a*, 140*b*.

After positioning the plank segments 110, the chain 180 is passed through the now overlapping holes 160 to further secure the plank segments.

While the support surfaces 170 are shown with an open space therebetween, it will be understood that in certain embodiments, both support surfaces may be part of a unitary surface, and the support surfaces may therefore be opposite edges of a single surface. Further, while the retainers 190 are shown as part of a single bracket with a connecting piece 220, it will be understood that they may be separate pieces, or may be part of the support surfaces themselves.

Figure 6:
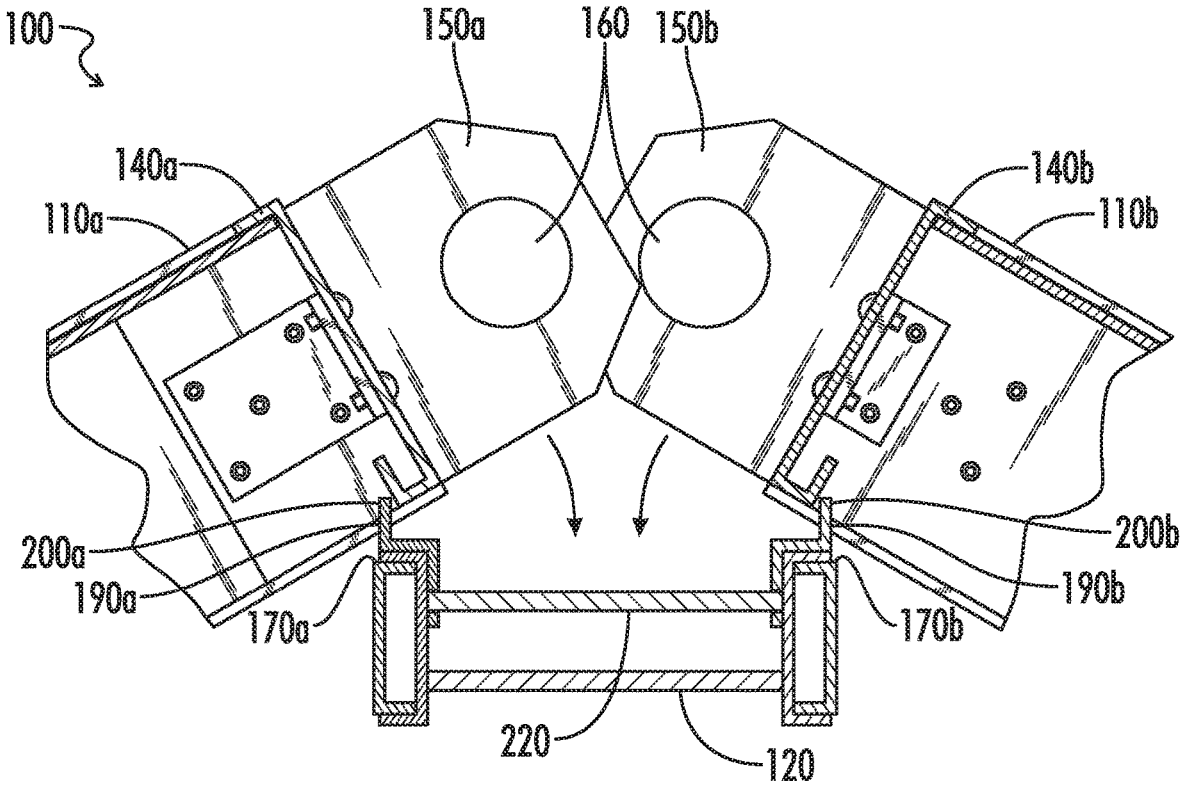
FIG. 6 is a cross section of the scaffolding system of FIG. 1 taken along line 4-4 partially assembled in a second configuration.

FIG. 6 is a cross section of the scaffolding system 100 of FIG. 1 taken along line 4-4 partially assembled in a second configuration. As shown, the plank segments 110*a*, 110*b* are positioned adjacent each other and are cantilevered against the retainers 190*a*, 190*b*. Accordingly, the end caps 140*a*, 140*b* rest against their respective retainers 190*a*, 190*b*. The plank segments 110 may then be lifted into place such that they are positioned as shown in FIG. 5. Further, in some embodiments, when raising or lowering the system, the planks segments 110 can be at an angle of up to 15 degrees. The retainers 190 will help prevent the plank from sliding off of their support, particularly if the plank segments 110 are not otherwise properly secured.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A support member for joining scaffolding plank segments comprising:

a first support surface for supporting a first scaffolding plank segment;

a second support surface parallel to the first support surface for supporting a second scaffolding plank segment;

a joining member for joining the first and second plank segments to each other;

a first retainer for retaining the first scaffolding plank segment on the first support surface; and a second retainer for retaining the second scaffolding plank segment on the second support surface, wherein the first and second retainers each comprise corresponding vertical surfaces for engaging an end cap of the corresponding scaffolding plank segment, the end cap extending across a width of the scaffolding plank segment.

2. The support member of claim 1 wherein the joining member is a chain for passing through endpieces of each of the first and second scaffolding plank segments.

3. The support member of claim 2 further comprising a fixation point for anchoring the chain while the chain is passed through the segments of the scaffolding staging segments.

4. The support member of claim 1 wherein the first and second retainers are connected by a central connector and together form a retaining bracket.

5. The support member of claim 1 wherein the first and second support surfaces are portions of a unitary surface.

6. The support member of claim 1 wherein the support member is a portion of a pump jack scaffolding bracket.

7. A scaffolding system comprising:

two scaffolding plank segments;

a bracket for supporting an end of each of the two scaffolding plank segments;

the bracket comprising:

a first support surface for supporting the end of a first of the two scaffolding plank segments;

a second support surface parallel to the first support surface for supporting the end of a second of the two scaffolding plank segments;

a joining member for joining the ends of the two scaffolding plank segments to each other;

a first retainer for retaining the first scaffolding plank segment on the first support surface; and a second retainer for retaining the second scaffolding plank segment on the second support surface, wherein each of the two scaffolding plank segments comprises an end cap extending across a width of the corresponding scaffolding plank segment, and wherein each end cap is retained by the corresponding retainer of the bracket, and wherein each retainer comprises a vertical surface that opposes and abuts a vertical surface of the end cap of the corresponding scaffolding plank segment.

8. The scaffolding system of claim 7 wherein each of the two scaffolding plank segments further comprises an endpiece with a hole and the joining member is a chain for passing through the hole of the endpieces of each of the two scaffolding planks.

9. The scaffolding system of claim 8 wherein the bracket further comprises a fixation point for anchoring the chain while the chain is passed through the holes of the endpieces.

10. The scaffolding system of claim 7 wherein the first and second retainers are connected by a central connector and together form a retaining bracket.

11. The scaffolding system of claim 7 wherein the bracket is a pump jack bracket.

* * * * *